United States Patent [19]

Miller, Jr. et al.

[11] Patent Number: 4,730,701

[45] Date of Patent: Mar. 15, 1988

[54] STEPLADDER ASSEMBLY

[75] Inventors: Norman L. Miller, Jr., Wooster; John D. Vasichko, Pataskala; Clarence H. Bucher; Nevin L. Sindlinger, both of Smithville, all of Ohio

[73] Assignee: Bauer Corporation, Wooster, Ohio

[21] Appl. No.: 21,681

[22] Filed: Mar. 4, 1987

[51] Int. Cl.[4] ..... E06C 7/08; E06C 7/10

[52] U.S. Cl. ..... 182/218; 182/220; 182/228

[58] Field of Search ..... 182/217, 216, 218, 219, 182/220, 228, 194

[56] References Cited

U.S. PATENT DOCUMENTS

| | | | |
|---|---|---|---|
| 1,401,470 | 12/1921 | Heider | 182/218 |
| 1,459,918 | 6/1923 | McGaw | 182/216 |
| 1,501,977 | 7/1924 | Weaver | 182/217 |
| 1,575,689 | 3/1926 | Kalgren | 182/216 |
| 1,722,534 | 7/1929 | Monjar | 182/216 |
| 1,838,796 | 12/1931 | Tingleaf | 182/220 |
| 1,926,885 | 9/1933 | Rich | 182/217 |
| 1,949,076 | 2/1934 | Kalgren | 182/216 |
| 1,961,781 | 6/1934 | Reagle | 182/228 |

*Primary Examiner*—Reinaldo P. Machado
*Attorney, Agent, or Firm*—Woodard, Emhardt, Naughton Moriarty & McNett

[57] ABSTRACT

A step ladder assembly has step assemblies mounted to its front rails using a bracket at each end of each step. Each bracket has truss anchor pocket means therein. Each truss rod is headed at both ends. The brackets are pre-assembled with a truss rod to a step before mounting the step to the rails. The truss anchor pocket in each bracket receives and abuttingly retains one of the truss rod heads. The brackets are riveted to the steps and to the rails.

12 Claims, 6 Drawing Figures

STEPLADDER ASSEMBLY

BACKGROUND OF THE INVENTION

This invention relates generally to wood step ladders, and more particularly to means and a method for assembly thereof to minimize the likelihood of the ladder becoming loose prematurely.

DESCRIPTION OF THE PRIOR ART

Braces, brackets, rods and truss blocks are commonly used throughout the ladder industry. Typically, the truss rods are headed on one end and threaded on the other, when assembled. Examples of this type of construction are found in U.S. Pat. Nos. 1,575,689 issued to Kalgren and U.S. Pat. No. 1,401,470 issued to Heider. Another type of step arrangement using a truss rod headed at one end and a nut threaded onto the other end is shown in Kalgren U.S. Pat. No. 1,949,076. Such arrangements are susceptible to the nuts working loose during ladder usage over a period of time.

Another reinforcing rod mounting arrangement is shown in U.S. Pat. No. 1,926,885 to Rich, but does not appear to be suitable for step ladders. Another approach to step reinforcement is shown in U.S. Pat. No. 1,501,977 to Weaver. In that disclosure, the truss members 4 are not rods, but are secured by threaded fasteners with nuts at the inner ends which can be turned to apply tension and tighten the truss members and side rails against the steps.

It is an object of the present invention to provide sturdy and permanent attachment of ladder steps to the rails, and sturdy and permanent employment of truss members in a way to obtain the usual benefits from them, but without the risk of becoming loose in use.

SUMMARY OF THE INVENTION

According to a typical embodiment of the present invention, a step ladder assembly has step assemblies mounted to its front rails using a bracket at each end of the steps. Each bracket has truss anchor pocket means therein. Each truss rod is headed at both ends. The brackets are pre-assembled with a truss rod to a step before mounting the step to the rails. The truss anchor pocket means in each bracket receives and abuttingly retains one of the truss rod heads. The brackets are riveted to the steps and to the rails.

DESCRIPTION OF THE PREFERRED EMBODIMENT

Figure 1:
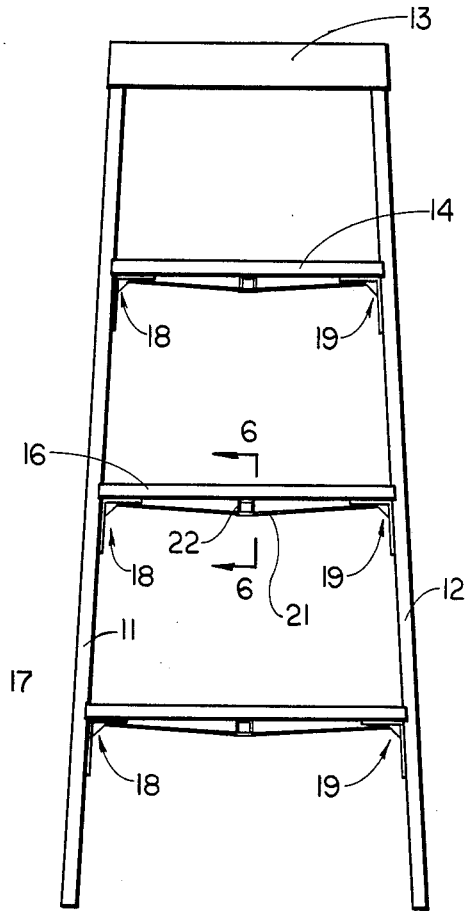
FIG. 1 is a front elevational view of a step ladder assembly with the steps mounted according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, the step ladder includes front rails 11 and 12, rear rails (not shown), and a ladder top cap 13 to which the rails are attached in a manner permitting the closing and opening of the ladder in the conventional step ladder fashion. Steps 14, 16 and 17 are mounted in vertically spaced relationship along the rails and the ends of each of the steps are received in grooves in the inner faces of the front rails 11 and 12. The rails and steps may be made of any suitable material, but wood is a material to which the present invention is very well adapted and particularly beneficial.

Referring further to FIG. 1, a pair of brackets is attached to the bottom of each step. All of the brackets, such as 18 at the right-hand rail 12 are identical to each other for all three steps. Similarly, the brackets such as 19 at the left-hand rail 11 are identical to each other. The brackets 18 and 19 are identical except to the extent that the left-hand, right-hand locations make them mirror images of each other. A truss rod 21 is connected between brackets 18 and 19. A truss block 22 is secured between the bottom of the step 16 and the truss rod 21.

Referring now to FIGS. 2 through 5 in particular, bracket 18 is a stamped steel angle having a generally rectangular step receiver portion 23, and a generally parallelogram shaped rail mount portion 24. The included angle between these portions would depend upon the taper between the generally parallel front rails 11 and 12. In the illustrated example, the overall taper is 6° so the included angle between the portions 23 and 24 is 93°. This angle is maintained by the formed gussets 26 and 27. Apertures 28 are provided in the step receiver 23 to receive rivets 29 (FIG. 2) which are headed at both ends and tightly fasten the bracket to the step. Apertures 31 are provided in the rail mount portion to receive the rivets 32 (FIG. 2) by which the brackets are securely attached to the rail 12, these rivets also being headed at both ends. It should be noted at this point, that the term "headed" as referred to herein, may be considered to include the factory heading of the rivet in its raw form, and the heading, swaging or other cold forming done at the other end when the rivet is installed in the rail or step.

A very important feature of the invention is the provision of the truss rod and its manner of mounting. An aperture 33 is provided in the step receiver portion 23 between the gussets 26 and 27 and adjacent the transition bend to the mount portion 24. A dimple 34 is provided in the mount portion at the same fore and aft location as aperture 33 with respect to the gussets, and adjacent the receiver portion 23 and serves as a pocket. A notch or slot 36 is provided in this dimple and communicating with the aperture 33.

Figure 6:
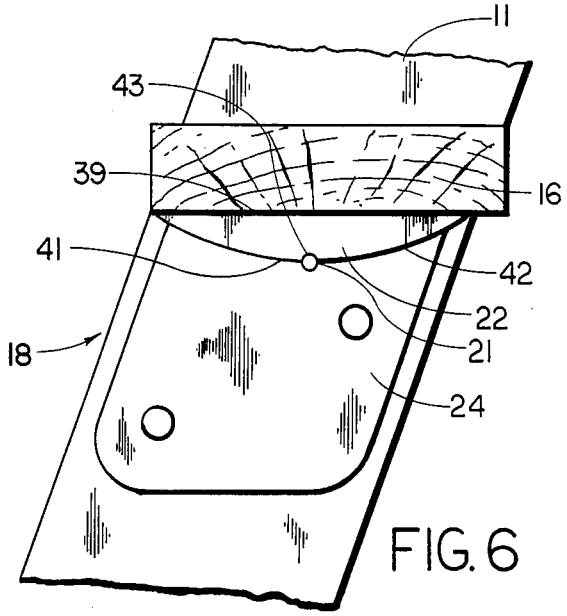
FIG. 6 is an enlarged fragmentary sectional view taken at line 6—6 in FIG. 1 and viewed in the direction of the arrows.

The truss rod 21 has heads at both ends. The heads are the button-type head such as best shown at 37R in FIG. 2 and 37L in FIG. 5. The size of this is small enough to be fitted through aperture 33, which is typically 0.406 inches in diameter. The dimple is 0.50 inches in diameter and 0.062 inches deep. The slot 36 is typically 0.219 inches wide, and the bottom of the slot is centered at 38, with the axis of the dimple and that of aperture 33 being co-planar and intersecting at right angles. The truss rod head is considerably larger in diameter than is the maximum width of the slot. Therefore, the head can be very positively anchored in the pocket, with the rod received in slot 36. The truss block 22 is an inverted channel section which, as shown in FIG. 6, has a flat top 39 abuttingly engaging the underside of the step 16. It has the downwardly projecting flanges tapering at 41 and 42 to the front and rear of the rod 21.

Figure 2:
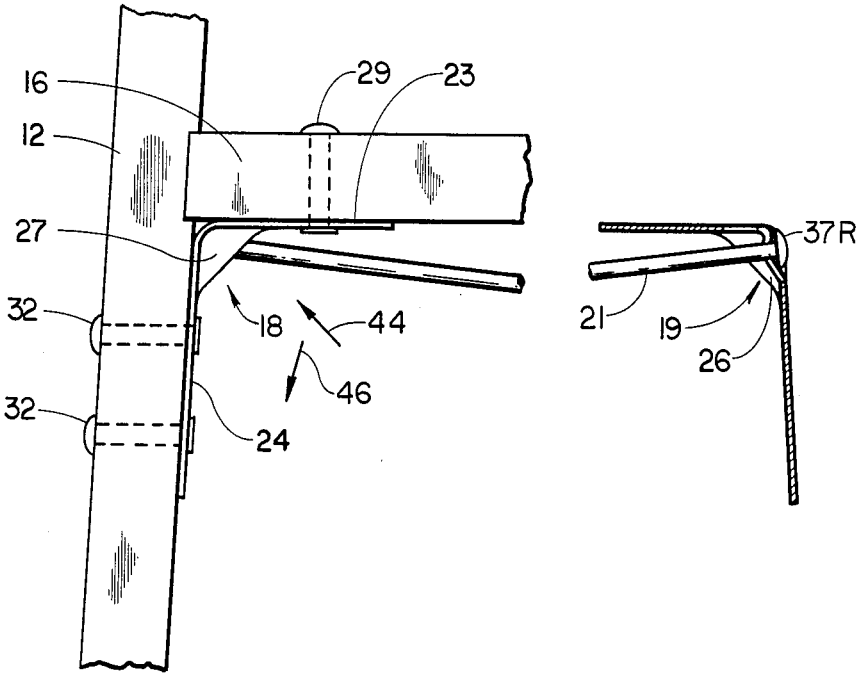
FIG. 2 is an enlarged fragmentary front elevational view showing the detail of the step attachment to the bracket and ladder rail at one end of the step and truss rod, and the truss rod connection to the bracket shown in section at the other end, a portion of the truss rod being omitted to conserve space.
Figure 3:
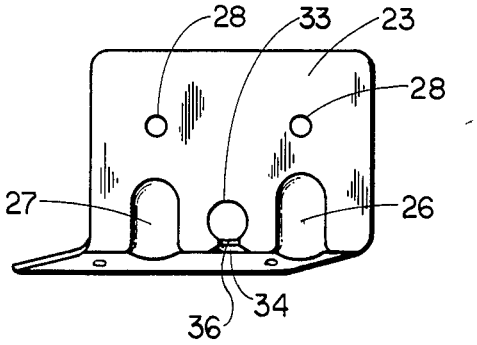
FIG. 3 is a top plan view of the step bracket.
Figure 4:
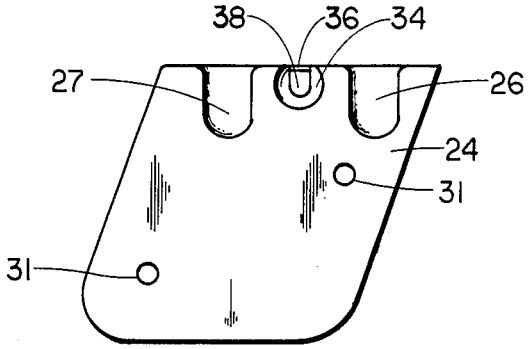
FIG. 4 is a side view of the attachment bracket looking at the rail-engaging side of the bracket.
Figure 5:
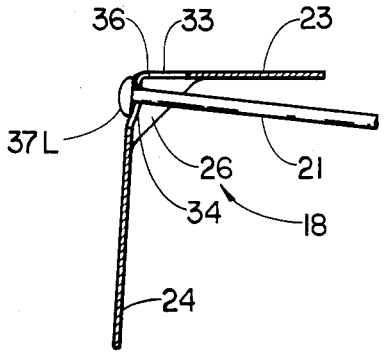
FIG. 5 is a fragmentary sectional view through the step bracket at the truss rod anchor socket.

In the assembly of the ladder, according to a typical embodiment of the present invention, and with the brackets separate from the steps and rails, the truss rod head is inserted into bracket 18 in the direction of arrow 44 in FIG. 2, between the gussets and through the aperture 33. Then it is moved in the direction of arrow 46 and the rod is received in the slot 36 so the head is in the recess or pocket 34. Then the bracket is attached to the bottom of the step by rivets 29. It is mounted inward from the end of the step just enough to permit the end of the step to be received in the groove in the rail to the full depth of the groove.

Then the bracket 19 for the other end of the step is mounted on the other end of the truss rod in the same way, with the head at that end being received through the aperture 33 of that bracket and received in the pocket in that bracket. Then the bracket 19 is fastened to the step with the rivets in the same way as was bracket 18. Then the truss block 22 is pushed into position between the rod 22 and step 16 until the rod 21 is in alignment with the notch therein and snaps into place in the notch 43. Due to the spacing of the brackets on the step, the length of the truss rod between the heads at opposite ends of it, and the thickness of the truss block, the truss rod is then in considerable tension such as to provide support at the truss block for the step. In addition, the step is thereby placed in compression between the brackets 18 and 19 at its opposite ends. Then the step assembly, including the brackets, truss rod and truss block is mounted in position between the rails 11 and 12, the step ends being slid into the slots provided on the inside faces of the rails. Then the brackets are fastened to the rails with the bracket mounts being attached to the inside faces of the rails by the rivets 32. All of the steps are mounted to the rails in the same way. Thereupon, the ladder front is completed.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A ladder step bracket comprising a unit of material formed to provide:

a step receiver and a ladder rail mount, said receiver and mount being at about a right angle relationship to each other;

gusset means formed in the receiver and mount to strengthen the angular relationship between the receiver and mount;

a pocket in said mount adjacent said gusset means to receive and retain the head of a truss rod in said pocket;

an aperture in said receiver adjacent said mount, to receive the head of a truss rod therethrough;

said pocket having a slot communicating with said aperture to receive a headed truss rod in the slot when the truss rod head is received in the pocket.

2. The bracket of claim 1 wherein: the unit of material is bent metal plate.

3. The bracket of claim 1 wherein: said step receiver is generally rectangular.

4. The bracket of claim 1 wherein: said mount is the shape of a parallelogram.

5. The bracket of claim 1 wherein: said gusset means comprise a pair of spaced gussets.

6. The bracket of claim 5 wherein:

said pocket is between said gussets.

7. The bracket of claim 6 wherein:

said aperture is between said gussets, and is larger than said slot.

8. The bracket of claim 7 wherein:

additional apertures are provided in said receiver and said mount to receive fasteners for attaching a ladder step to the receiver and a ladder rail to the mount.

9. In a method of fabricating a ladder front, the combination of the steps of:

mounting a truss rod to a first ladder step bracket, with a head of the truss rod positioned in a head retainer in the first bracket;

attaching the first bracket to the bottom of a ladder step;

mounting the truss rod to a second ladder step bracket, with a head of the truss rod positioned in a head retainer in the second bracket; and attaching the second bracket to the bottom of the ladder step.

10. The method of claim 9 and further comprising the step of:

wedging a truss block between the bottom of the ladder step and the truss rod, thereby placing the rod in tension between the brackets and placing the ladder step in compression between the brackets.

11. The method of claim 9 and further comprising the steps of:

placing the ladder step between first and second front rails of a ladder; and attaching said first bracket to said first rail and attaching said second bracket to said second rail.

12. The method of claim 11 wherein:

the step of attaching the brackets to the rails includes riveting the brackets to the rails.

* * * * *